US005914694A

United States Patent [19]

Raab

[11] Patent Number: 5,914,694

[45] Date of Patent: Jun. 22, 1999

[54] DUAL-BAND, DUAL POLARIZATION RADIATING STRUCTURE

[75] Inventor: Anthony Rowland Raab, Kanata, Canada

[73] Assignee: CAL Corporation, Ottawa, Canada

[21] Appl. No.: 08/710,772

[22] Filed: Sep. 19, 1996

[51] Int. Cl.[6] ..... H01Q 13/10

[52] U.S. Cl. ..... 343/771; 343/725

[58] Field of Search ..... 343/771, 725, 343/770; H01Q 5/00, 13/02, 21/00, 13/10

[56] References Cited

U.S. PATENT DOCUMENTS

| | | | |
|---|---|---|---|
| 3,747,111 | 7/1973 | Fletcher et al. | 343/725 |
| 4,096,482 | 6/1978 | Walters | 343/776 |

*Primary Examiner*—Michael C. Wimer
*Attorney, Agent, or Firm*—Pascal & Associates

[57] ABSTRACT

An integrated multi-band and multi-polarization antenna array comprising: a plurality of first waveguides located in spaced parallel relationship, the waveguides being dimensioned so as to carry signals of a first wavelength, the waveguides containing slots in a first surface so as to radiate the signals carried by the first waveguides with horizontal polarization, a plurality of second waveguides located in spaced parallel relationship to each other and to the first waveguides, and bridging and abutting the first waveguides adjacent a second surface opposite the first surface, the second waveguides being dimensioned to carry signals of the first wavelength, the second waveguides containing slots in a surface parallel to the first surface so as to radiate signals carried by the second waveguides with vertical polarization, a third waveguide located in spaced parallel relationship to the first and second waveguides, dimensioned to carry signals of a second wavelength, and containing slots in a surface parallel to the first surface so as to radiate signals carried by the third waveguide with vertical polarization, the third waveguide being disposed between walls of the first waveguides and above a second waveguide at a location whereat electric field reflections from faces thereof of energy emitted from the second waveguide add in antiphase.

12 Claims, 2 Drawing Sheets

DUAL-BAND, DUAL POLARIZATION RADIATING STRUCTURE

FIELD OF THE INVENTION

This invention relates to the field of integrated multiband and multipolarized array antennae.

BACKGROUND TO THE INVENTION

Synthetic aperture radar (SAR) systems rely on antenna designs which radiate single or dual polarized beams with well controlled radiation patterns. Such antenna designs may take the form of arrays of radiating primary elements such as patch antennae or waveguide slots. In all types of arrays, it is essential to the efficient operation of the SAR system that the radiated fields have linear frequency response, have high aperture illumination efficiency, well controlled sidelobes and good polarization purity.

In addition, for space based applications, the antenna must have low mass, compact form and high structural integrity to meet the loads imposed on the antenna during launch and subsequent operation in orbit. With all of these design requirements achieved it is possible using SAR techniques to form high resolution images of the earth's surface from orbit.

When operating the SAR at one frequency and with one polarization, imagery of useful but limited utility can be achieved. By increasing the frequency and polarization content of the SAR, it is possible to achieve a wider range of imagery, giving a significantly expanded degree of interpretation to the images.

For example, it has been found that L-band, with its longer wavelength, gives more useful imagery through foliage, while C-band gives more useful imagery of sea ice. It has also been found that horizontal polarization at both L-band and C-band is more useful for detecting the thickness of sea ice, than vertical polarization.

In U.S. Pat. No. 4,243,990, issued Jan. 6, 1981, to J. T. Nimit et al, an integrated multiband array antenna is described. The antenna illustrated in FIGS. 3 and 4 of that patent is comprised of a first array of plural parallel waveguides which contain transverse slots on one surface, so as to radiate horizontally polarized signals. Another array of coaxial waveguides is positioned parallel to the first array, between and abutting the waveguides of the first array. Longitudinal slots on the upper surface of the second array of waveguides cause radiation of signals carried by the second array, with vertical polarization. The patent states that different frequency combinations, or the same frequency, can be emitted by this structure.

The antenna described in this patent is limited to two signals, either one frequency with dual (horizontal and vertical) polarization, or two frequencies in dual polarization. However it cannot emit using two frequencies, one being in dual polarization and the other being at vertical polarization. To obtain the latter, a second antenna array on a second spacecraft is required, an expensive proposition.

In the event such an antenna array is used on one spacecraft, the resolution of images will be limited to that which can be obtained using the above described antenna array.

SUMMARY OF THE INVENTION

A preferred embodiment of the present invention is an integrated dual band, dual polarization polarimetric antenna. Such an antenna has significantly increased capability to form high resolution images. In addition, the cross-polarized reflections can be absorbed by the antenna, and can be used for processing and interpretation. Since the spacecraft systems can be readily shared to take advantage of the additional information contained in the reflected energy absorbed by the antenna system without a significant increase in cost, such an antenna is highly desirable.

Since the signals from the antenna array can be shared by several spacecraft systems, this in effect provides the capability of a second spacecraft without the additional cost.

In accordance with an embodiment of the present invention, an integrated multi-band and multi-polarization antenna array is comprised of a plurality of first waveguides located in spaced parallel relationship, the waveguides being dimensioned so as to carry signals of a first wavelength, the waveguides containing slots in a first surface so as to radiate the signals carried by the first waveguides with horizontal polarization, a plurality of second waveguides located in spaced parallel relationship to each other and to the first waveguides, and bridging and abutting the first waveguides adjacent a second surface opposite the first surface, the second waveguides being dimensioned to carry signals of the first wavelength, the second waveguides containing slots in a surface parallel to the first surface so as to radiate signals carried by the second waveguides with vertical polarization, a conductive obstacle located between the first waveguides and above the second waveguide at a location whereat electric field reflections from faces of the first waveguides of energy emitted from the second waveguide.

In accordance with another embodiment of the invention, an integrated multi-band and multi-polarization antenna array is comprised of a plurality of first waveguides located in spaced parallel relationship, the waveguides being dimensioned so as to carry signals of a first wavelength, the waveguides containing slots in a first surface so as to radiate the signals carried by the first waveguides with horizontal polarization, a plurality of second waveguides located in spaced parallel relationship to each other and to the first waveguides, and bridging and abutting the first waveguides adjacent a second surface opposite the first surface, the second waveguides being dimensioned to carry signals of the first wavelength, the second waveguides containing slots in a surface parallel to the first surface so as to radiate signals carried by the second waveguides with vertical polarization, a third waveguide located in spaced parallel relationship to the first and second waveguides, dimensioned to carry signals of a second wavelength, and containing slots in a surface parallel to the first surface so as to radiate signals carried by the third waveguide with vertical polarization, the third waveguide being disposed between walls of the first waveguides and above a second waveguide at a location whereat electric field reflections from faces of the first waveguides of energy emitted from the second waveguide add in antiphase.

In accordance with another embodiment, an antenna array is comprised of first apparatus for radiating signals of one frequency with horizontal and vertical polarization, and further radiating apparatus integrated with the first radiating apparatus, for radiating a signal of another frequency with vertical polarization. Preferably the further radiating apparatus is located within the bounds of the first radiating apparatus.

BRIEF INTRODUCTION TO THE DRAWINGS

A better understanding of the invention will be obtained by considering the detailed description below, with reference to the following drawings, in which:

FIG. 1 is an isometric view of an antenna system using the present invention, and FIG. 2 is an isometric view of a preferred embodiment of the present invention.

DETAILED DESCRIPTION OF THE INVENTION

Figure 1:
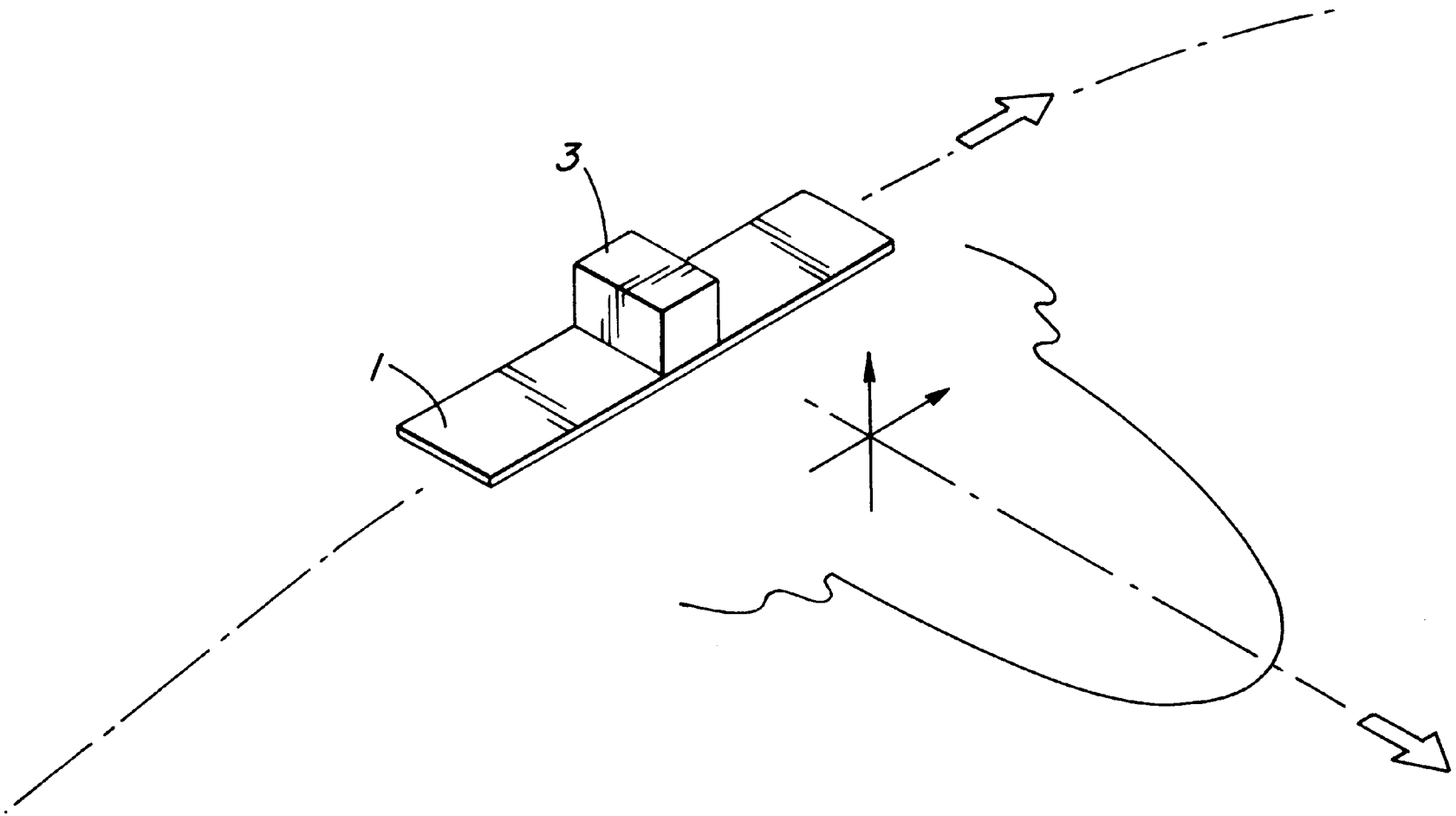

FIG. 1 illustrates an SAR antenna 1 carried on a satellite 3. The antenna is deployed with its major dimension aligned along track, i.e. the direction in which the satellite is moving. The along track direction is parallel with what is defined herein as horizontal polarization, as shown by one of the crossed arrows. Vertical polarization is shown as being orthogonal to horizontal polarization.

Beam scanning is effected in the across track plane by appropriate excitation of the elements of the antenna array, which are disposed across track in the antenna. FIG. 1 also illustrates a graph of the along track section of the radiated beam.

Figure 2:
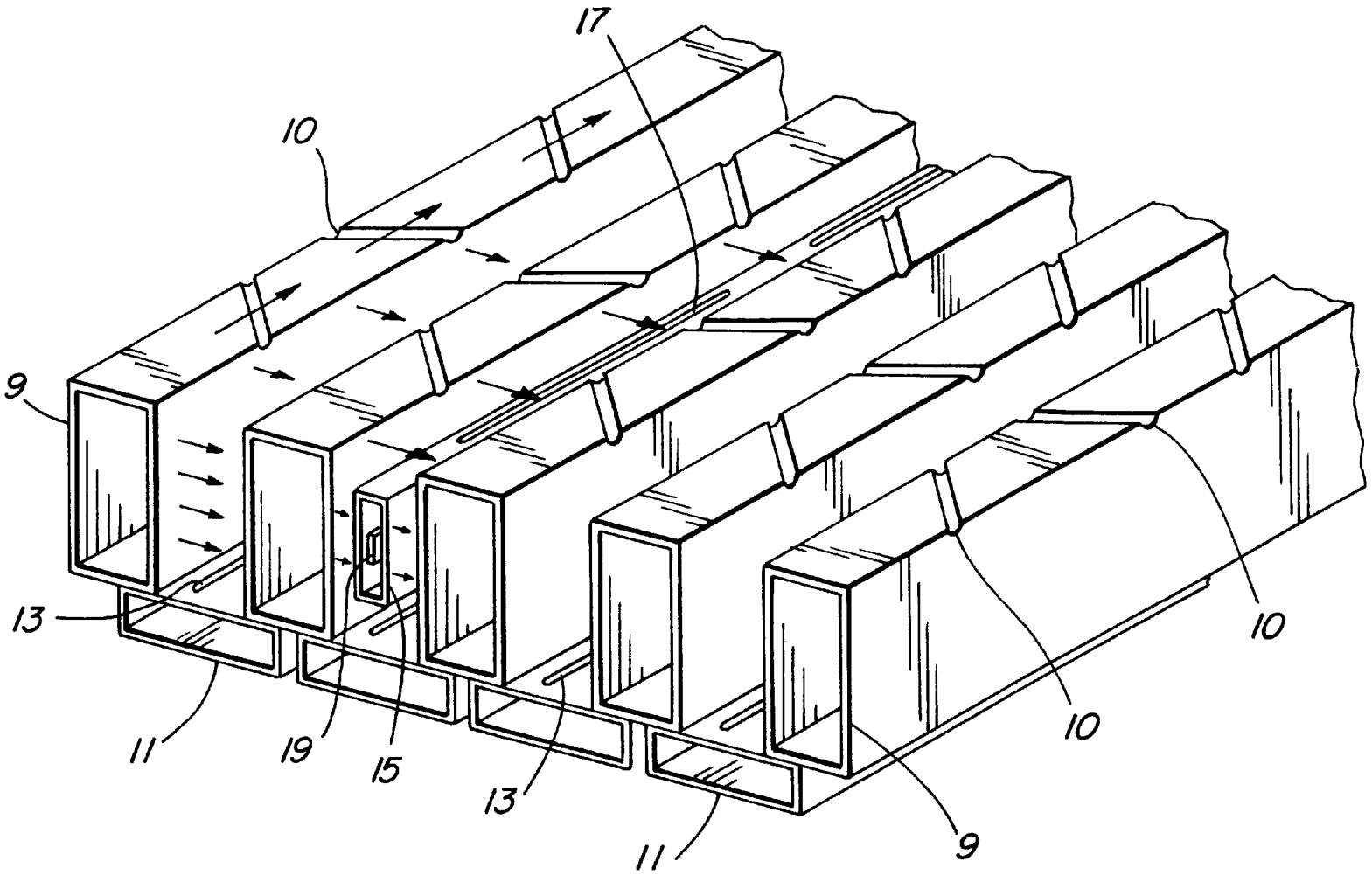

FIG. 2 illustrates a preferred structural embodiment of the present invention. A plurality of first slotted waveguides 9 are disposed in an array parallel to each other. A plurality of angled transverse slots 10 are contained in a first, upper surface of the waveguides. The dimensions of the waveguides and the positions, sizes and orientations of the slots can be as described in the aforenoted patent, to carry a signal of a predetermined wavelength and to radiate the signal with horizontal polarization.

A plurality of second slotted waveguides 11 are disposed in an array bridging the waveguides 9, across the walls of adjacent waveguides 9. The waveguides 11 contain slots 13 elongated in the axial direction of waveguides 11, between the adjacent side walls of waveguides 9. It is preferred that the longer cross-sectional dimensions of waveguides 9 are in the transverse direction. The dimensions of waveguides 11 and slots 13 are such as to carry and radiate a signal with vertical polarization. It is preferred that the signal carried by waveguides 11 are of the same wavelength as the signal carried by waveguides 9.

The result of the above structure, if both waveguide arrays carry the same wavelength signal, is to emit the signal with horizontal polarization from waveguide array 9 and with vertical polarization 11 (resulting in dual polarization).

In accordance with an embodiment of the present invention, a third waveguide 15 is disposed in a location between and spaced from the walls of a pair of the first waveguides 9, and is spaced from and above the slot of the second waveguide, parallel to the other waveguides. The third waveguide contains elongated slots 17. The invention is not limited to using a single third waveguide 15 as will be explained later.

The dimensions of the third waveguide, and its elongated slots, are such as to carry and radiate a further wavelength signal, which, if the other signals are of the same wavelength, constitute a second wavelength. The further wavelength signal has vertical polarization with the illustrated structure. The frequency of the signal radiated by the third waveguide should be lower than the signals radiated by the first and second waveguides.

The third waveguide can be coaxial in form, wherein a conductor 19 passes along the axis of the third waveguide.

The invention can be used, for example with L and C-band wavelength signals. Thus the antenna can form a dual polarization C-band waveguide radiating structure, into which is inserted a single, vertical polarization L-band transverse electromagnetic (TEM) mode, radiating structure. The result is a three-channel polarimetric antenna system which occupies the same volume as the C-band antennae used in operating SAR systems, and provides amplitude and phase data for co- and cross-polarized fields at C-band and single polarization amplitude and phase data at L-band. The antenna system thus can provide a compact dual band L- and C-band, polarimetric C-band, antenna system which provides enhanced interpretation capability.

Of course other wavelengths can be used, but for the ease of description herein, L- and C- bands will be referred to.

Thus the C-band dual polarization system is comprised of two waveguide radiating arrays, one with slots (which can be machined) in an upper one of the narrow walls of its waveguides, radiating a horizontally polarized beam, the other with longitudinal slots (which can be machined) in their broad walls, radiating a vertically polarized beam.

The longitudinal axes are preferably located parallel to the track of the satellite, to allow for scanning. The waveguide arrays are preferably spaced in the across track plane so as to allow substantial scanning cross track without the generation of grating lobes.

Disposition of the horizontally polarized waveguide radiators 9 as described above, in which the radiating slots 10 are located in the narrow walls, creates a series of troughs at the bases of which are located the vertically polarized waveguide radiators 11, in which the radiating slots 13 are located in their broad walls.

The radiated field of the vertically polarized waveguide array is confined, at the plane of launching from the waveguide, to the trench region where it propagates in a so-called parallel plate mode, without significant perturbation. As the wave leaves the parallel plate region formed by the trench, and radiates into free space, the beam forms according to the usual laws of physics.

However, since the boundary conditions which determine the field within the parallel plate region are such that the electric field vector terminates normal to the broad wall surfaces of the horizontally polarized waveguides, I have found that I can insert a further conductive structure or obstacle (e.g. metallic structure) into the parallel plate region whereby the obstacle has minimal effect on the vertically polarized field, since the same boundary conditions exist.

By selecting the dimensions of the inserted obstacle, the reflections from the obstacle can be minimized, thus allowing unimpeded passage of the C-band radiation from waveguides 11 around the obstacle, without violation of the boundary conditions within the parallel plate region. The form of the obstacle can be, for example a suitable housing for a coaxial transmission line capable of supporting a longer wavelength, such as that of an L-band frequency, shown in FIG. 2 as waveguide or waveguides 15. However the obstacle could be some other structure.

By forming appropriate radiating slots in the coaxial waveguide 15, I have found that vertically polarized radiation will leave the coaxial waveguide in a well controlled manner and will radiate out of the parallel plate region in accordance with the same boundary conditions as apply to the C-band radiation.

Thus the spacing between the horizontal polarization radiators 9 is selected to allow scanning in the across track plane without generating grating lobes which would impair the performance of a SAR system. This spacing forms the aforenoted trenches of parallel plate regions between the horizontally polarized waveguides 9. At the bases of these trenches the vertically polarized C-band arrays 11 are located, which radiate electric fields which have vectors as shown in FIG. 2. These electric fields terminate on the conducting walls of the horizontally polarized waveguides, thus satisfying the boundary conditions required by electromagnetic theory.

As shown in FIG. 2, the radiating waveguides 15 can be rectangular in cross-section, and in a successful embodiment the cross-sections were 2.5 cm by 1 cm. The longer dimension is chosen so that reflections from the faces of the obstacle facing the faces of the waveguides 9 add in antiphase, and so provides a low impedance, and a good impedance match to incident C-band energy.

The shorter dimension is chosen to provide a satisfactory internal dimension for the inner coaxial conductor which is required to support the transmission of L-band energy in a coaxial TEM mode.

It is preferred that the dimensions of the obstacle (e.g. the waveguide 15) are chosen so that the longer dimension is approximately a half wavelength long, thus causing reflections from the discontinuity caused by one face to be in anti-phase with reflections from the discontinuity from the second face. In the case of a symmetrical obstacle such as a rectangular section, the discontinuities will be substantially identical, except for being reversed to the direction of flow of the incident signal.

Also in the case of a rectangular obstacle, the second, narrow, dimension should be chosen to suit its other function as the supporter of a radiating element for the L-band frequencies.

The proximity of the obstacle to the neighbouring walls of the C-band waveguides results in fringing capacitances at the planes of the two discontinuities. The capacitances have the effect of shortening the length of the obstacle required to anti-phase the reflections from the discontinuities. Thus the two dimensions are, to a small degree, interrelated.

To achieve a satisfactory impedance relationship for the radiating element at L-band, where a form of slot radiator is located in accordance with a preferred embodiment of the invention, the circumference of the obstacle is preferred to be approximately a half wavelength, although this is not critical.

The C-band electric field vectors are normal to the conducting surfaces of the rectangular obstacle (the waveguide 15), so that, with the appropriate dimensions as described above, impedance effects are minimized and the obstacle appears to be invisible to C-band radiation.

A radiating structure such as a series of longitudinal slots 17, designed to radiate efficiently at L-band, is capable of launching L-band radiation into the parallel plate region, obeying the same boundary conditions as the C-band radiation.

Further, since the incident C-band radiation, in transmit, does not impinge on the L-band slots which are specifically tuned to the L-band frequency, crosscoupling from C to L-band is minimized. Conversely, coupling from the L-band radiator into the C-band waveguide is zero since the C-band waveguide dimensions are too small to support L-band radiation, the waveguide being cut off to L-band.

Because the frequency ratio of C-band to L-band is approximately 3, the scaling properties of antenna theory can be invoked, thus allowing approximately the same grating lobe performance to be achieved by placing an L-band radiating waveguide 15, 17 array in every third trench.

There being no further obstacles to either C-band or L-band radiation, both frequency bands will be radiated efficiently and independently, without significant crosscoupling, into free space, forming beams determined by standard techniques in antenna design.

A person understanding this invention may now conceive of alternative structures and embodiments or variations of the above. All of those which fall within the scope of the claims appended hereto are considered to be part of the present invention.

I claim:

1. An integrated multi-band and multi-polarization antenna array comprising:

(a) a plurality of first waveguides located in spaced parallel relationship, the waveguides being dimensioned so as to carry signals of a first wavelength, the waveguides containing slots in a first surface so as to radiate said signals carried by the first waveguides with horizontal polarization, (b) a plurality of second waveguides located in spaced parallel relationship to each other and to the first waveguides, and bridging and abutting the first waveguides adjacent a second surface opposite said first surface, the second waveguides being dimensioned to carry signals of said first wavelength, the second waveguides containing slots in a surface parallel to the first surface so as to radiate signals carried by the second waveguides with vertical polarization, (c) a third waveguide located in spaced parallel relationship to the first and second waveguides, dimensioned to carry signals of a second wavelength, and containing slots in a surface parallel to the first surface so as to radiate signals carried by the third waveguide with vertical polarization, the third waveguide being disposed between walls of said first waveguides and above a second waveguide at a location whereat electric field reflections from faces thereof of energy emitted from the second waveguide add in antiphase.

2. An antenna array as defined in claim 1 in which the length of the cross-section of the third waveguide is approximately a half of the second wavelength.

3. An antenna array as defined in claim 2 in which the third waveguide has symmetrical cross-sectional dimensions relative to a central axis parallel to the length of the third waveguide.

4. An antenna array as defined in claim 3 in which the third waveguide is rectangular in cross-section.

5. An antenna as defined in claim 3 in which the circumference of the cross-section of the third waveguide is about equal the second wavelength.

6. An antenna array as defined in claim 1 further including a conductor centrally located within and along the third waveguide forming a coaxial third waveguide.

7. An antenna array as defined in claim 1 in which the first wavelength is C band and the second wavelength is L band.

8. An antenna array as defined in claim 1 in which the signals of the second wavelength are lower in frequency than the signals of the first wavelength.

9. An antenna array as defined in claim 8 in which the first wavelength is C band and the second wavelength is L band.

10. An antenna array as defined in claim 6 including plural ones of said third waveguides, disposed between spaced ones of said first waveguides and above a second waveguide at a location whereat electric field reflections form faces thereof of energy emitted from the second waveguide below the third waveguide add in antiphase.

11. An integrated multi-band and multi-polarization antenna array comprising:

(a) a plurality of first waveguides located in spaced parallel relationship, the waveguides being dimensioned so as to carry signals of a first wavelength, the waveguides containing slots in a first surface so as to radiate said signals carried by the first waveguides with horizontal polarization, (b) a plurality of second waveguides located in spaced parallel relationship to each other and to the first waveguides, and bridging and abutting the first waveguides adjacent a second surface opposite said first surface, the second waveguides being dimensioned to carry signals of said first wavelength, the second waveguides containing slots in a surface parallel to the first surface so as to radiate signals carried by the second waveguides with vertical polarization, (c) a conductive obstacle located between said first waveguides and above the second waveguide at a location whereat electric field reflections from faces of the first waveguides of energy emitted from the second waveguide add in antiphase.

12. An antenna array as defined in claim 11 in which said obstacle is a radiating structure of a vertically polarized signal having lower frequency than that of the signals radiated by the first and second waveguides.

* * * * *